US009697787B2

(12) United States Patent
Park et al.

(10) Patent No.: US 9,697,787 B2
(45) Date of Patent: Jul. 4, 2017

(54) DISPLAY DEVICE

(71) Applicant: SAMSUNG DISPLAY CO., LTD., Yongin, Gyeonggi-Do (KR)

(72) Inventors: Suhyeong Park, Gyeongju-si (KR); Jimyoung Seo, Suwon-si (KR); KyoungWon Lee, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 49 days.

(21) Appl. No.: 14/323,554

(22) Filed: Jul. 3, 2014

(65) Prior Publication Data

US 2015/0070344 A1 Mar. 12, 2015

(30) Foreign Application Priority Data

Sep. 9, 2013 (KR) ..... 10-2013-0108049
Jan. 17, 2014 (KR) ..... 10-2014-0005975

(51) Int. Cl.
*G09G 3/36* (2006.01)

(52) U.S. Cl.
CPC ..... *G09G 3/3648* (2013.01); *G09G 3/3614* (2013.01); *G09G 2300/0426* (2013.01); *G09G 2300/0876* (2013.01); *G09G 2310/0205* (2013.01)

(58) Field of Classification Search
CPC ..... G09G 3/36; G09G 3/3685; G09G 2310/0272; G09G 3/3648; G09G 3/3614; G09G 2310/0205; G09G 2300/0876; G09G 2300/0426; G09G 3/3688; G09G 2310/0275; G09G 2310/06; G09G 2340/125
See application file for complete search history.

(56) References Cited

U.S. PATENT DOCUMENTS

| | | | | |
|---|---|---|---|---|
| 7,079,097 | B2 | 7/2006 | Lee | |
| 7,463,232 | B2 | 12/2008 | Lee et al. | |
| 8,044,948 | B2 | 10/2011 | Lee | |
| 8,259,051 | B2 | 9/2012 | Lee | |
| 2003/0107543 | A1* | 6/2003 | Nakano ..... | G09G 3/3607 345/90 |

(Continued)

FOREIGN PATENT DOCUMENTS

| | | |
|---|---|---|
| KR | 1020080012566 | 8/2008 |
| KR | 1020110057535 | 6/2011 |

(Continued)

*Primary Examiner* — Md Saiful A Siddiqui
(74) *Attorney, Agent, or Firm* — F. Chau & Associates, LLC

(57) ABSTRACT

A display device is provided. The display device includes a display panel, a gate driver, and a data driver. The display panel includes a plurality of pixels connected to a plurality of gate lines for receiving gate signals, a plurality of data lines for receiving data voltages, and a storage line for receiving a storage voltage. The gate driver is configured to generate the gate signals. The data driver is configured to operate individually in first and second frequency periods to generate the data voltages. The data voltages include a positive data voltage and a negative data voltage, and polarities of the data voltages are inverted every two data lines during the first frequency period and inverted every data line during the second frequency period.

8 Claims, 13 Drawing Sheets

(56) References Cited

U.S. PATENT DOCUMENTS

| | | | | |
|---|---|---|---|---|
| 2006/0164350 | A1 | 7/2006 | Kim et al. | |
| 2009/0189881 | A1* | 7/2009 | Ooishi | G09G 3/20 345/211 |
| 2009/0244424 | A1 | 10/2009 | Kim et al. | |
| 2011/0205254 | A1* | 8/2011 | Umezaki | G09G 3/3648 345/690 |
| 2012/0249492 | A1* | 10/2012 | Kim | G09G 3/3648 345/204 |
| 2012/0320026 | A1* | 12/2012 | Kitayama | G09G 3/36 345/212 |
| 2013/0113811 | A1* | 5/2013 | Choi | G09G 3/3648 345/520 |

FOREIGN PATENT DOCUMENTS

| | | |
|---|---|---|
| KR | 1020110067227 | 6/2011 |
| KR | 1020130022952 | 3/2013 |

* cited by examiner

DISPLAY DEVICE

CROSS-REFERENCE TO RELATED APPLICATIONS

This U.S. non-provisional patent application claims priority under 35 U.S.C. §119 to Korean Patent Applications Nos. 10-2013-0108049, filed on Sep. 9, 2013 and 10-2014-0005975, filed on Jan. 17, 2014, the disclosures of which are incorporated by reference herein in their entireties.

TECHNICAL FIELD

The present invention relates to a display device, or more particularly, to a display device capable of reducing power consumption thereof and displaying a still image thereon.

DISCUSSION OF THE RELATED ART

Display devices such as a liquid crystal display device, an organic light emitting display device, an electrowetting display device, an electrophoretic display device or the like have been developed.

As an example, the display device includes a display panel including pixels for displaying an image, a gate driver for applying gate signals to the pixels, and a data driver for applying data signals to the pixels. The pixels receive the gate signals through gate lines. The pixels receive the data signals through data lines in response to the gate signals and display gray scales corresponding to the data signals.

SUMMARY

According to an exemplary embodiment of the present invention, a display device is provided. The display device includes a display panel, a gate driver, and a data driver. The display panel includes a plurality of pixels connected to a plurality of gate lines for receiving gate signals, a plurality of data lines for receiving data voltages, and a storage line for receiving a storage voltage. The gate driver is configured to generate the gate signals. The data driver is configured to operate in first and second frequency periods to generate the data voltages. The data voltages include a positive data voltage and a negative data voltage, and polarities of the data voltages are inverted every two data lines during the first frequency period and inverted every data line during the second frequency period.

In an exemplary embodiment of the present invention, the data driver may be configured to operate in synchronization with a first frequency during the first frequency period and to operate in synchronization with a second frequency having a frequency lower than the first frequency during the second frequency period.

In an exemplary embodiment of the present invention, the pixels may include a plurality of first pixels arranged in a first row and a plurality of second pixels arranged in a second row adjacent to the first row, and the first row and the second row may be repeatedly arranged in a column direction.

In an exemplary embodiment of the present invention, the data lines may include a plurality of first data lines and a plurality of second data lines. The first pixels may be connected to a corresponding one of the first data lines, the second pixels may be connected to a corresponding one of the second data lines, and the first and second pixels may be commonly connected to a corresponding one of the gate lines.

In an exemplary embodiment of the present invention, the storage line may include a first storage line connected to the first pixels and a second storage line connected to the second pixels.

In an exemplary embodiment of the present invention, the first frequency period may include a plurality of first frames, the data driver may receive image signals every first frame, and the polarity of the data voltages may be inverted every first frame.

In an exemplary embodiment of the present invention, the storage voltage may have a direct-current voltage level during the first frequency period.

In an exemplary embodiment of the present invention, the second frequency period may include a plurality of second sub-frequency periods, each of the second sub-frequency periods may include a second frame and a first period following the second frame, and the data driver may receive still image signals during the second frame to convert the still image signals to the data voltages and may not output the data voltages during the first period.

In an exemplary embodiment of the present invention, the second frame may be longer than the first frame and the polarities of the data voltages may be inverted every second frame.

In an exemplary embodiment of the present invention, the storage voltage may have a direct current voltage level during the second frame.

In an exemplary embodiment of the present invention, the storage voltage may include a first storage voltage changed to a voltage level inversely proportional to a discharge level when a positive pixel charged with the positive data voltage is discharged during the first period and a second storage voltage changed to a voltage level inversely proportional to a discharge level when a negative pixel charged with the negative data voltage is discharged during the first period. The first and second storage voltages may be applied to the pixels through the storage line in accordance with the polarities of the pixels during the first period.

In an exemplary embodiment of the present invention, each of the pixels may include a switching device, a pixel electrode, and a storage electrode. The switching device may be connected to a corresponding one of the gate lines and a corresponding one of the data lines. The pixel electrode may be connected to the switching device and disposed to face a common electrode applied with a common voltage. The storage electrode may be connected to a corresponding one of the storage line and disposed to face the pixel electrode.

In an exemplary embodiment of the present invention, the pixels may include a plurality of first pixels and a plurality of second pixels alternately arranged with the first pixels in row and column directions, and the data lines may include first data lines and second data lines. A pixel among the first pixels arranged in a first row and a second column and a pixel among the second pixels arranged in the first row and a third column may be commonly connected to a corresponding one of the first data lines. A pixel among the first pixels arranged in a second row and a first column and a pixel among the second pixels arranged in the second row and the second column may be commonly connected to a corresponding one of the second data lines. The pixel among the first pixels arranged in the first row and the second column and the pixel among the second pixels arranged in the second row and the second column may be commonly connected to a corresponding one of the gate lines. The first row may be adjacent to the second row, the first column may be adjacent to the second column, and the second column may be adjacent to the third column.

According to an exemplary embodiment of the present invention, a display device is provided. The display device includes a display panel, a gate driver, and a data driver. The display panel includes a plurality of pixels connected to a plurality of gate lines for receiving gate signals, a plurality of data lines for receiving data voltages, and a storage line for receiving a storage voltage. The gate driver is configured to generate the gate signals. The data driver is configured to operate individually in first and second frequency periods to generate the data voltages. The data voltages include a positive data voltage and a negative data voltage, and polarities of the data voltages are inverted every data line during the first frequency period and inverted every two data lines during the second frequency period.

In an exemplary embodiment of the present invention, the pixel may include a plurality of first pixels and a plurality of second pixels alternately arranged with the plurality of first pixels in row and column directions. The data lines may include first data lines and second data lines. The first pixels in a first row and a second row may be connected to a corresponding one of the second data lines. The second pixels in the first row and the second row may be connected to a corresponding one of the first data lines. The first and second pixels in the first row and the second row may be commonly connected to a corresponding one of the gate lines. The second row may be adjacent to the first row.

In an exemplary embodiment of the present invention, the first frequency period may include a plurality of first frames. The data driver may be configured to receive image signals every first frame and to convert the image signals to the data voltages. The polarities of the data voltages may be inverted every first frame, and the storage voltage may have a direct current voltage level during the first frequency period.

In an exemplary embodiment of the present invention, the second frequency period may include a plurality of second sub-frequency periods. Each of the second sub-frequency periods may include a second frame and a first period following the second frame. The data driver may be configured to receive still image signals during the second frame and to convert the still image signals to the data voltages, and the data driver may be configured not to output the data voltages during the first period.

In an exemplary embodiment of the present invention, the second frame may be longer than the first frame. The polarities of the data voltages may be inverted every second frame, and the storage voltage may have the direct current voltage level during the second frame.

In an exemplary embodiment of the present invention, the storage voltage may include a first storage voltage and a second storage voltage. The first storage voltage may be changed to a voltage level inversely proportional to a discharge level when a positive pixel charged with the positive data voltage is discharged during the first period. The second storage voltage may be changed to a voltage level inversely proportional to a discharge level when a negative pixel charged with the negative data voltage is discharged during the first period. The first and second storage voltages may be applied to the pixels through the storage line in accordance with the polarities of the pixels during the first period.

According to an exemplary embodiment of the present invention, a display device is provided. The display device includes a display panel, a gate driver, and a data driver. The display panel is configured to display an image signal. The display panel includes a plurality of pixels. The gate driver is configured to generate gate signals. The data driver is configured to generate data voltages including a positive voltage and a negative voltage. The data driver is configured to operate in synchronization with a first frequency or a second frequency. The second frequency is lower than the first frequency. The data driver is configured to operate in synchronization with the second frequency when the image signal is a still image signal, and to operate in synchronization with the first frequency when the image signal is not the still image signal. The pixels include a plurality of first pixels and a plurality of second pixels alternately arranged with the plurality of first pixels in row and column directions.

BRIEF DESCRIPTION OF THE DRAWINGS

The above and other features of the present invention will become more apparent by describing in detail exemplary embodiments thereof with reference to the accompanying drawings wherein.

DETAILED DESCRIPTION OF THE EMBODIMENTS

Hereinafter, exemplary embodiments of the present invention will be described in detail with reference to the accompanying drawings. The present invention may, however, be embodied in various forms and should not be construed as being limited to the embodiments set forth herein. It will be understood that when an element or layer is referred to as being "on", "connected to" or "coupled to" another element or layer, it can be directly on, connected or coupled to the other element or layer or intervening elements or layers may be present. As used herein, the singular forms, "a", "an" and "the" are intended to include the plural forms as well, unless the context clearly indicates otherwise. Hereinafter, the present invention will be described in detail with reference to the accompanying drawings.

Figure 1:
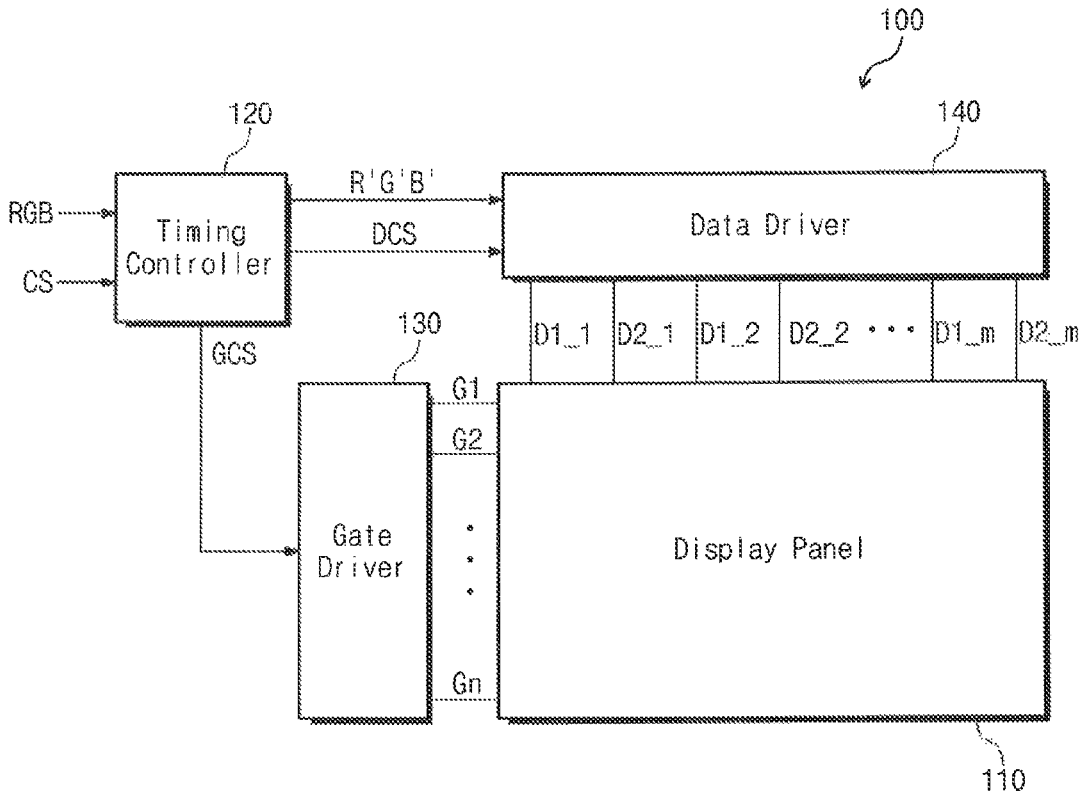
FIG. 1 is a block diagram showing a display device according to an exemplary embodiment of the present invention.

FIG. 1 is a block diagram showing a display device 100 according to an exemplary embodiment of the present invention.

Referring to FIG. 1, the display device 100 includes a display panel 110, a timing controller 120, a gate driver 130, and a data driver 140.

Figure 2:
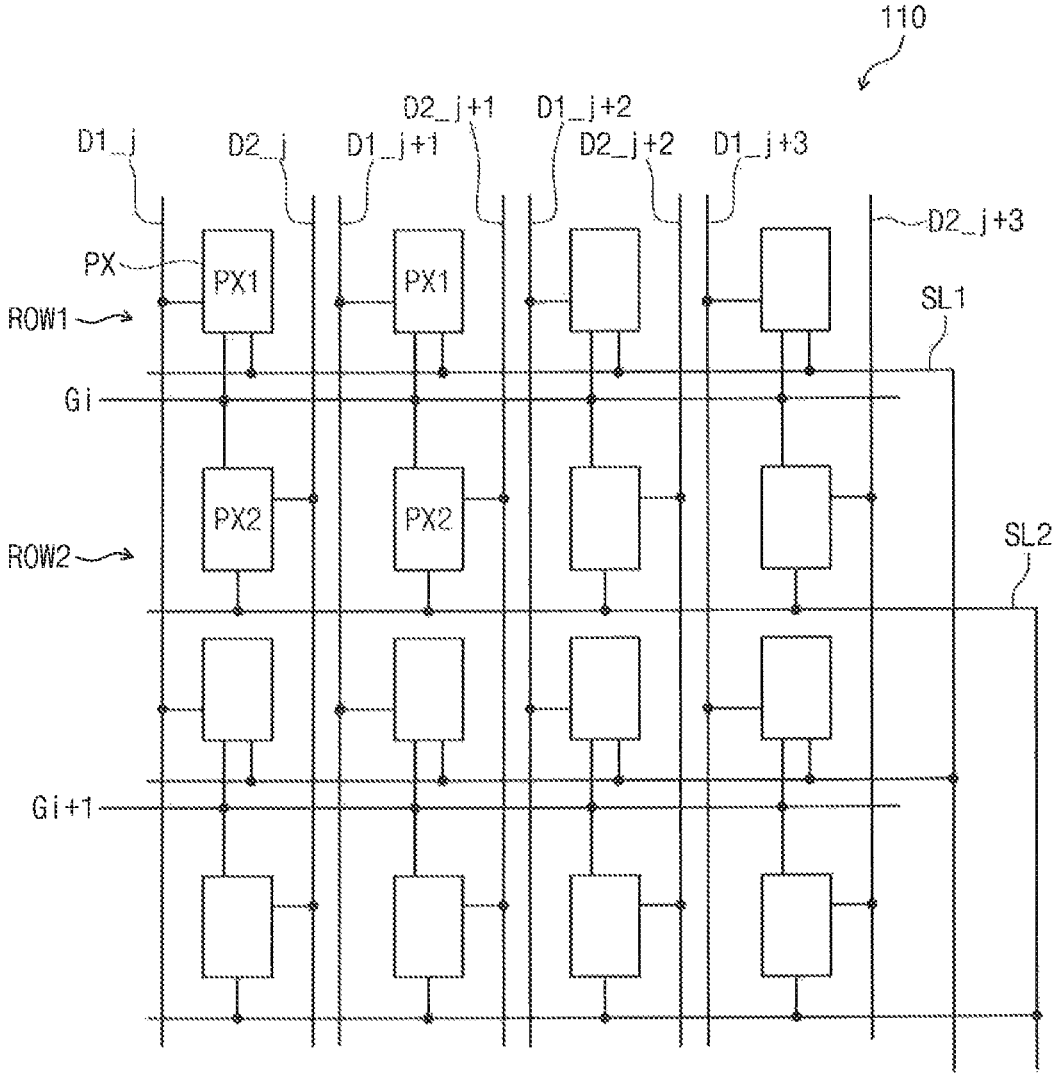
FIG. 2 is a view showing a configuration of a display panel of the display device shown in FIG. 1, according to an exemplary embodiment of the present invention.

The display panel 110 includes a plurality of pixels (as shown in FIG. 2) arranged in a matrix form. Gate lines G1 to Gn extend in a row direction and are connected to the gate driver 130 and the display panel 110. The gate lines G1 to Gn extend in the row direction and are connected to the pixels of the display panel 110. Here, "n" is an integer number greater than zero (0).

Data lines D1_1, D2_1, . . . , D1_*m*, and D2_*m* extend in a column direction and are connected to the data driver 140 and the display panel 110. The data lines D1_1, D2_1, . . . , D1_*m*, and D2_*m* extend in the column direction and are connected to the pixels of the display panel 110. Here, "m" is an integer number greater than zero (0).

The data lines include a plurality of first data lines D1_1 to D1_*m* and a plurality of second data lines D2_1 to D2_*m*. The plurality of second data lines D2_1 to D2_*m* corresponds to each of the plurality of first data lines D1_1 to D1_*m*. The first data lines D1_1 to D1_*m* correspond to odd-numbered data lines among the data lines D1_1, D2_1, . . . , D1_*m*, and D2_*m* and the second data lines D2_1 to D2_*m* correspond to even-numbered data lines among the data lines D1_1, D2_1, . . . , D1_*m*, and D2_*m*.

The arrangement of the pixels of the display panel 110, the connection between the pixels and the gate lines G1 to Gn, and the connection between the pixels and the data lines D1_1, D2_1, . . . , D1_*m*, and D2_*m* will be described in detail with reference to FIG. 2.

The timing controller 120 receives image signals RGB and a control signal CS from an external device, e.g., a system board. The timing controller 120 converts a data format of the image signals RGB to a data format appropriate to an interface between the data driver 140 and the timing controller 120 and applies image signals R'G'B' having the converted data format to the data driver 140.

The timing controller 120 generates a gate control signal GCS and a data control signal DCS in response to the control signal CS. The gate control signal GCS controls an operation timing of the gate driver 130 and the data control signal DCS controls an operation timing of the data driver 140.

The timing controller 120 applies the gate control signal GCS to the gate driver 130 and applies the data control signal DCS to the data driver 140.

The gate driver 130 outputs gate signals in response to the gate control signal GCS provided from the timing controller 120. The gate lines G1 to Gn receive the gate signals from the gate driver 130. The gate signals are sequentially applied to the pixels of the display panel 110 through the gate lines G1 to Gn.

The data driver 140 converts the image signals R'G'B' to data voltages in analog form in response to the data control signal DCS provided from the timing controller 120. The data voltages include a positive (+) data voltage and a negative (−) data voltage. The data driver 140 determines polarities of the data voltages in response to the data control signal DCS.

The pixels receive the data voltages in response to the gate signals, display gray scales corresponding to the data voltages, and display desired images.

Figure 3:
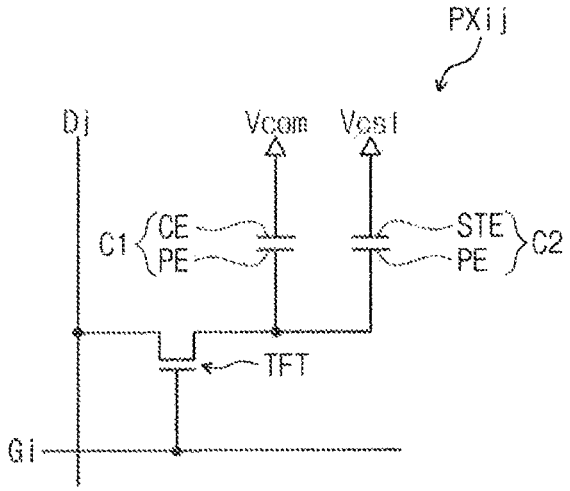
FIG. 3 is an equivalent circuit diagram showing one pixel of a plurality of pixels shown in FIG. 2, according to an exemplary embodiment of the present invention.

FIG. 2 is a view showing a configuration of a display panel of the display device shown in FIG. 1, according to an exemplary embodiment of the present invention, and FIG. 3 is an equivalent circuit diagram showing one pixel of pixels shown in FIG. 2, according to an exemplary embodiment of the present invention.

For the convenience of explanation, FIG. 2 shows sixteen pixels PX arranged in four rows by four columns, but the number of the pixels PX is not limited thereto. In addition, since the pixels PX shown in FIG. 2 have the same structure and function as those of a pixel PXij shown in FIG. 3, only one pixel PXij has been shown in FIG. 3.

Referring to FIG. 2, the display panel 110 includes the pixels PX and storage lines SL1 and SL2. The pixels PX are arranged in the matrix form.

As shown in FIG. 2, each pixel PX has a rectangular shape having a short side in the row direction and a long side in the column direction, but the present invention is not be limited thereto. For instance, each pixel PX may have the rectangular shape having the long side in the row direction and the short side in the column direction.

Although not shown in figures, the pixels PX include red, green, and blue pixels. The red, green, and blue pixels are arranged in various ways along the row and column directions, but the present invention is not limited thereto. For instance, the pixels PX may include red, green, blue, and white pixels. The red, green, blue, and white pixels may be arranged in the row direction, the column direction, or the matrix form of two rows by two columns.

The pixels PX include first pixels PX1 arranged in a first row ROW1 and second pixels PX2 arranged in a second row ROW2 adjacent to the first row ROW1. The first and second rows ROW1 and ROW2 are repeatedly arranged in the column direction.

Among the data lines D1_*j*, D2_*j*, . . . , D1_*j*+3, and D2_*j*+3 shown in FIG. 2, the odd-numbered data lines D1_*j*, D1_*j*+1, D1_*j*+2, and D1_*j*+3 may be referred to as first data lines D1_*j*, D1_*j*+1, D1_*j*+2, and D1_*j*+3, and the even-numbered data lines D2_*j*, D2_*j*+1, D2_*j*+2, and D2_*j*+3 may be referred to as second data lines D2_*j*, D2_*j*+1, D2_*j*+2, and D2_*j*+3.

The first pixels PX1 are connected to the first data lines D1_*j*, D1_*j*+1, D1_*j*+2, and D2_*j*+3, respectively, and the second pixels PX2 are connected to the second data lines D2_*j*, D2_*j*+1, D2_*j*+2, and D2_*j*+3, respectively.

The first pixels PX1 arranged in the first row ROW1 and the second pixels PX2 arranged in the second row ROW2 may be commonly connected to a corresponding gate lines Gi and Gi+1, respectively. For instance, a leftmost first pixel PX1 in the first row ROW1 and a leftmost second pixel PX2 in the second row ROW2 are commonly connected to the gate line Gi.

The storage lines SL1 and SL2 include a first storage line SL1 and a second storage line SL2. The first and second storage lines SL1 and SL2 are alternately connected to the pixels PX in the unit of a row. For instance, the first storage line SL1 is connected to the first pixels PX1 arranged in the first row ROW1 and the second storage line SL2 is connected to the second pixels PX2 arranged in the second row ROW2.

Referring to FIG. 3, the pixel PXij includes a thin film transistor TFT, a first capacitor C1, and a second capacitor C2. The thin film transistor TFT serves as a switching device.

The thin film transistor TFT is connected to the gate line Gi, the data line Dj, the first capacitor C1, and the second capacitor C2. For instance, the thin film transistor TFT includes a gate electrode connected to the gate line Gi, a source electrode connected to the data line Dj, and a drain electrode connected to the first and second capacitors C1 and C2.

The thin film transistor TFT is turned on in response to the gate signal provided through the gate line Gi. The turned-on thin film transistor TFT receives the data voltage through the data line Dj.

The thin film transistor TFT provides the data voltage to the first and second capacitors C1 and C2. The first capacitor C1 receives the data voltage and a common voltage Vcom, and the first capacitor C1 is charged with a pixel voltage corresponding to a difference between the data voltage and the common voltage Vcom. Accordingly, the pixel PXij displays the gray scale corresponding to the pixel voltage.

The storage lines SL1 and SL2 may receive a storage voltage Vcst. The second capacitor C2 is connected to the storage line SL1 or SL2. The storage voltage Vcst may be applied to a storage capacitor CST (e.g., the second capacitor C2) of each pixel PX through the storage lines SL1 or SL2. The second capacitor C2 may be charged with a voltage corresponding to a difference between the data voltage and the storage voltage Vcst. The second capacitor C2 may supplement the voltage charged in the first capacitor C1.

The display panel 110 includes a pixel electrode PE connected to the drain electrode of the thin film transistor TFT, a common electrode CE disposed to face the pixel electrode PE, and a storage electrode STE branched from the storage line SL1 or SL2.

The pixel electrode PE receives the data voltage through the thin film transistor TFT. The common electrode CE receives the common voltage Vcom. The storage electrode STE receives the storage voltage Vcst.

The pixel electrode PE and the common electrode CE respectively form first and second electrodes of the first capacitor C1. Although not shown in figures, a liquid crystal layer may be disposed between the first and second electrodes of the first capacitor C1. The first capacitor C1 may be a liquid crystal capacitor.

The pixel electrode PE and the storage electrode STE are disposed to face each other to serve as the first and second electrodes of the second capacitor C2, respectively. Although not shown in figures, an insulating layer may be disposed between the first and second electrodes of the second capacitor C2. The second capacitor C2 may be a storage capacitor.

Although not shown in figures, the display device 100 includes a voltage generator. The voltage generator generates the common voltage Vcom and the storage voltage Vcst, and applies the common voltage Vcom and the storage voltage Vcst to the display panel 110.

Figure 4:
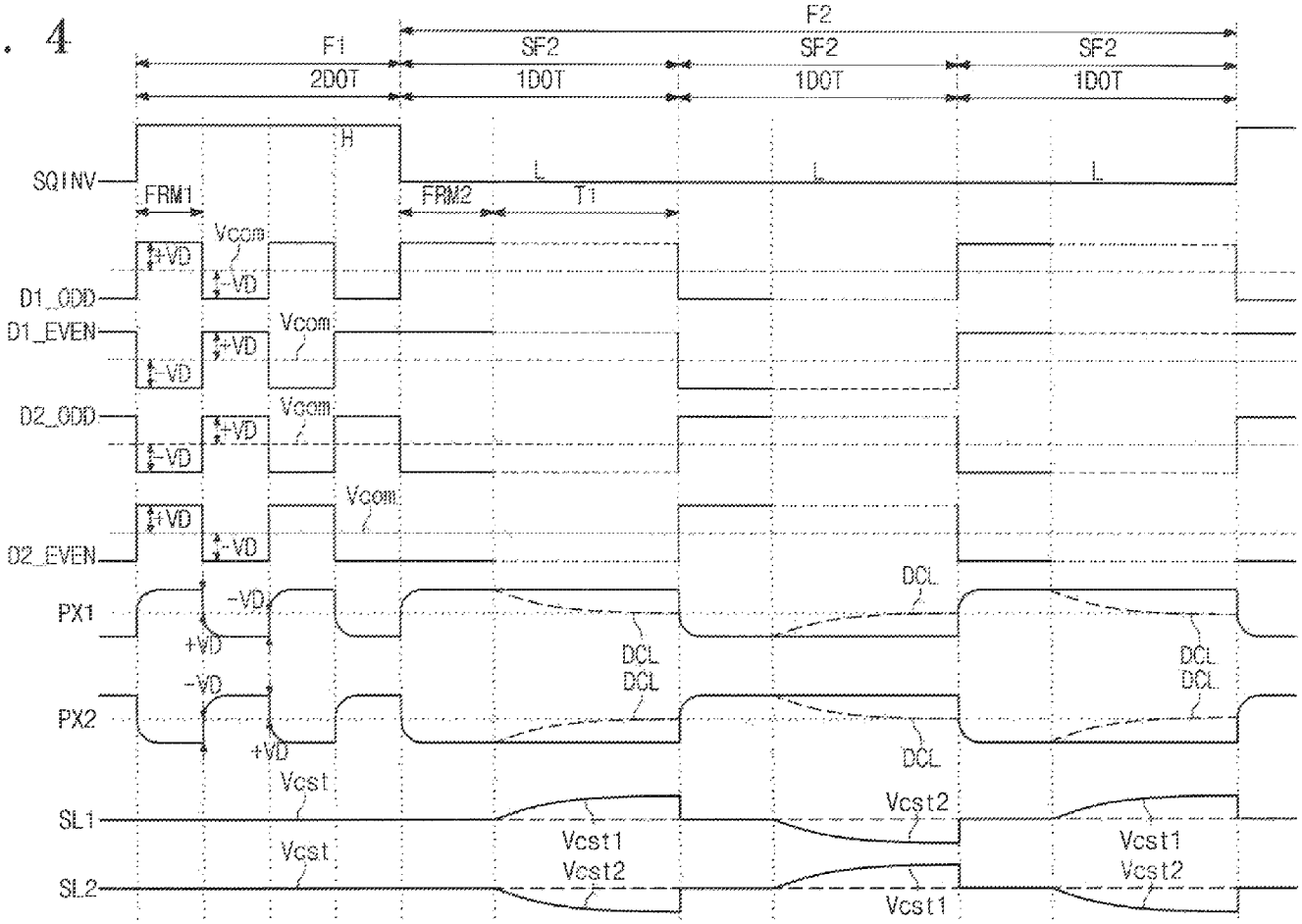
FIG. 4 is a signal timing diagram showing an operation of the pixels shown in FIG. 2, according to an exemplary embodiment of the present invention.
Figure 5A:
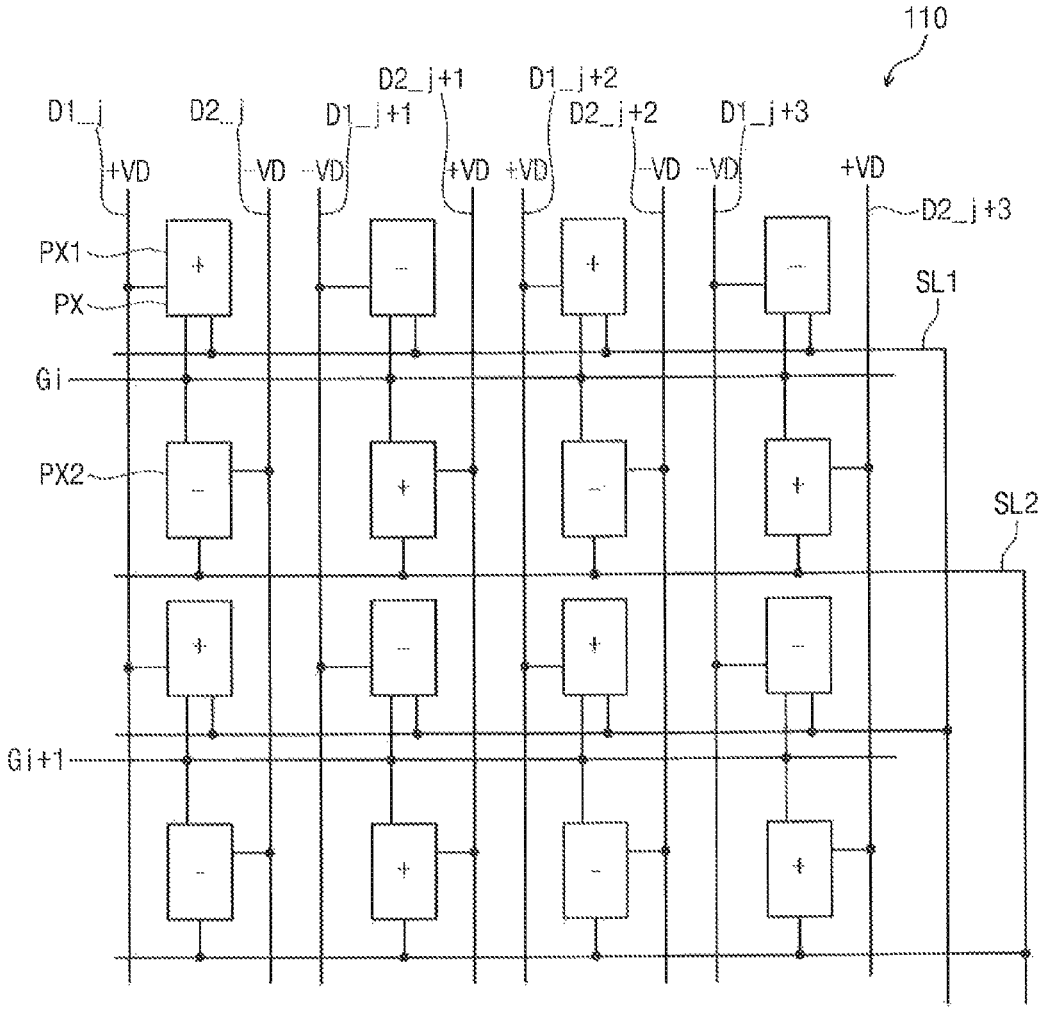
FIGS. 5A and 5B are views showing driving states of the pixels shown in FIG. 2, according to an exemplary embodiment of the present invention.
Figure 5B:
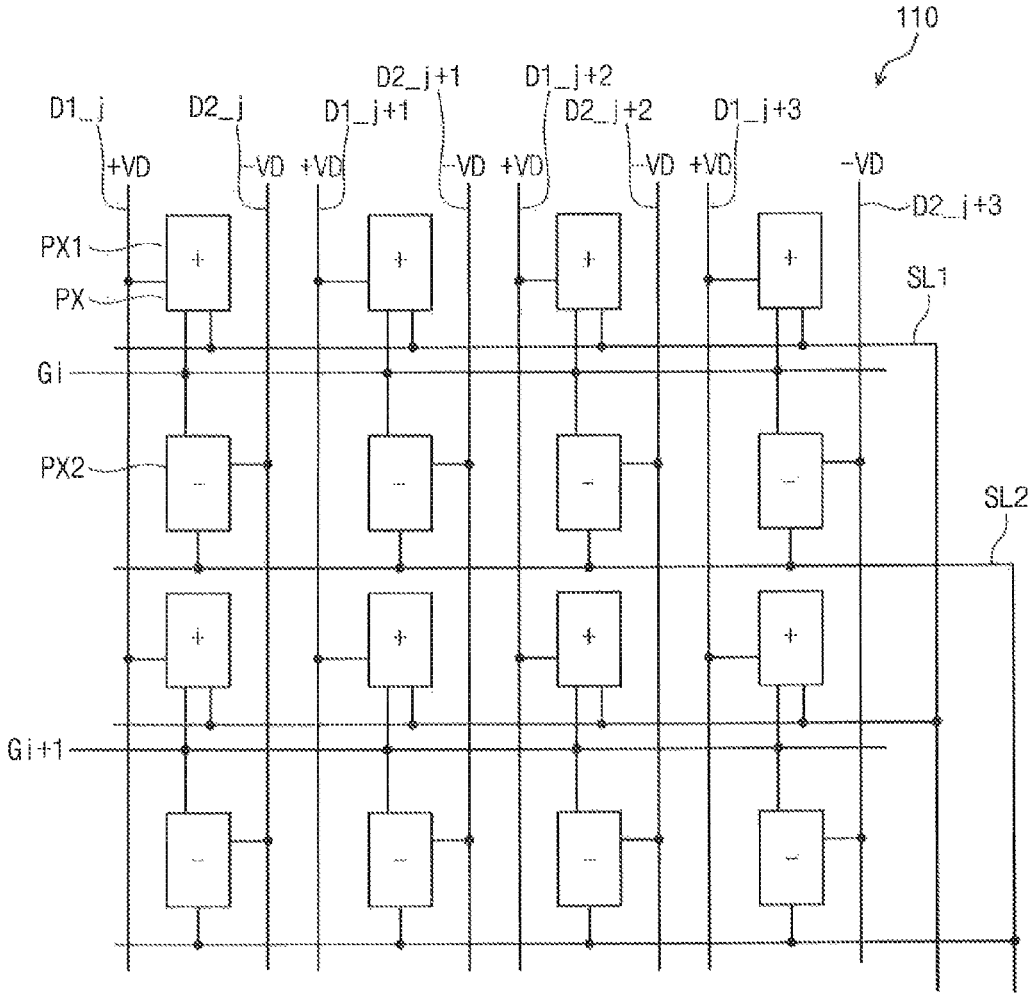

FIG. 4 is a signal timing diagram showing an operation of the pixel shown in FIG. 2, according to an exemplary embodiment of the present invention, and FIGS. 5A and 5B are views showing driving states of the pixel according to the signal timing shown in FIG. 4, according to an exemplary embodiment of the present invention.

Referring to FIGS. 4, 5A, and 5B, the data control signal DCS includes an output control signal SQINV. The output control signal SQINV has a first level H and a second level L. The first level H corresponds to a high level H and the second level L corresponds to a low level L smaller than the high level H.

The display device 100 is operated in response to a first frequency and a second frequency lower than the first frequency. For instance, when the image signals are updated every frame, the display device 100 is operated in synchronization with the first frequency. In addition, when the image signals are not updated every frame, the display device 100 is operated in synchronization with the second frequency. For instance, when the image signals are still image signals which are not updated, the display device 100 is operated in synchronization with the second frequency.

Hereinafter, a period in which the display device 100 is operated in synchronization with the first frequency is referred to as a first frequency period F1, and a period in which the display device 100 is operated in synchronization with the second frequency is referred to as a second frequency period F2. In addition, the data driver 140 is operated in the first frequency period F1 and the second frequency period F2.

The output control signal SQINV has the first level H during the first frequency period F1 and has the second level L during the second frequency period F2.

A positive data voltage +VD has a level higher than that of the common voltage Vcom. A negative data voltage −VD has a level lower than that of the common voltage Vcom.

A frame period in which the image signals are provided during the first frequency period F1 may be defined as a first frame FRM1. For instance, the first frequency period F1 may include a plurality of first frames FRM1. The image signals are updated every first frame FRM1. During the first frequency period F1, the polarities of the data voltages applied to the data lines D1_1, D2_1, . . . , D1_*m*, and D2_*m* are inverted every frame.

The output control signal SQINV having the first level H is used to control the data driver 140 such that the data driver 140 outputs the data signals that are inverted every two dots 2DOT (hereinafter, referred to as "two-dot inversion data signals").

For instance, the data driver 140 applies the two-dot inversion data signals to the data lines D1_1, D2_1, . . . , D1_*m*, and D2_*m* every first frame FRM1 in response to the output control signal SQINV having the first level H. For instance, the polarities of the data voltages are inverted every two data lines during the first frequency period F1. For instance, the positive data voltages +VD and the negative data voltages −VD are alternately applied to the data lines D1_1, D2_1, . . . , D1_*m*, and D2_*m* every two data lines.

Hereinafter, the charging operation of the pixels PX in the leftmost first frame FRM1 among the first frames FRM1 in FIG. 4 will be described in detail. In the leftmost first frame FRM1 among the first frames FRM1, the positive data voltages +VD are applied to odd-numbered first data lines D1_ODD (e.g., D1_*j* and D1_*j*+2) among the first data lines D1_1, . . . , D1_*m*. In addition, in the leftmost first frame FRM1 among the first frames FRM1, the negative data voltages −VD are applied to odd-numbered second data lines D2_ODD (e.g., D2_*j* and D2_*j*+2) among the second data lines D2_1, . . . , D2_*m*.

Thus, the positive data voltages +VD are applied to the odd-numbered first data lines D1_*j* and D1_*j*+2 and the negative data voltages −VD are applied to the odd-numbered second data lines D2_*j* and D2_*j*+2, as shown in FIG. 5A.

During the leftmost first frame FRM1, the negative data voltages −VD are applied to the even-numbered first data lines D1_EVEN (e.g., D1_*j*+1 and D1_*j*+3) among the first data lines D1_1, . . . , D1_*m*, and the positive data voltages +VD) are applied to the even-numbered second data lines D2_EVEN (e.g., D2_*j*+1 and D2_*j*+3) among the second data lines D2_1, . . . , D2_*m*.

Thus, the negative data voltages −VD are applied to the even-numbered first data lines D1_*j*+1 and D1_*j*+3 and the positive data voltages +VD are applied to the even-numbered second data lines D2_j+1 and D2_j+3 as shown in FIG. 5A.

In addition, as shown in FIG. 5A, the positive data voltages +VD and the negative data voltages −VD are alternately applied to the data lines D1_1, D2_1, . . . , D1_m, and D2_m every two data lines. The positive data voltages +VD and the negative data voltages −VD are applied to the pixels PX through the data lines D1_1, D2_1, . . . , D1_m, and D2_m.

During the first frame period FRM1, the storage voltage Vcst having a direct current (DC) level is applied to the first and second storage lines SL1 and SL2.

Each of the pixels PX applied with the positive data voltages +VD is charged with the pixel voltage corresponding to the positive data voltage +VD. For the convenience of explanation, FIG. 5A shows the polarities of the pixels PX. The pixels PX applied with the positive data voltages +VD are shown as positive pixels (+).

Each of the pixels PX applied with the negative data voltages −VD is charged with the pixel voltage corresponding to the negative data voltages −VD. The pixels PX applied with the negative data voltages −VD are shown as negative pixels (−).

The pixels PX applied with the data voltages in the leftmost first frame FRM1 are driven in one-dot inversion as shown in FIG. 5A. For instance, the polarities of the pixels PX are inverted every row and every column, e.g., the one-dot inversion.

As described above, the polarities of the data voltages applied to the data lines D1_1, D2_1, . . . , D1_m, and D2_m during the first frequency period F1 are inverted every first frame FRM1. Accordingly, the polarities of the pixels PX are inverted every first frame FRM1. For instance, the pixels PX in a present first frame FRM1 are charged with the pixel voltages having different polarities from those of the pixels PX in a previous first frame FRM1. In addition, the pixels PX are driven in the one-dot inversion every first frame.

As an example, FIG. 4 shows voltage charge-timings of a first pixel PX1 arranged in the first row and the first column and a second pixel PX2 arranged in the first row and the second column. The first and second pixels PX1 and PX2 are shown in FIGS. 5A and 5B.

Referring to FIG. 4, the first pixel PX1 of FIGS. 5A and 5B is charged with the positive data voltage +VD in the leftmost first frame FRM1, and the polarities of the first pixel PX1 are inverted every first frame FRM1. In addition, the second pixel PX2 of FIGS. 5A and 5B is charged with the negative data voltages −VD in the leftmost first frame FRM1, and the polarities of the second pixel PX2 are inverted every first frame FRM1.

When each pixel PX maintains the same polarity every first frame FRM1, the display panel 110 may be deteriorated. However, when the polarities of the pixels PX are inverted every first frame FRM1, the display panel 110 may be prevented from being deteriorated.

The polarities of the data voltages may be inverted in a frame whenever the gate signals are applied to the pixels PX. A period in which the gate signals are applied to the pixels PX is referred to as "1H period". In this case, since the polarities of the data voltages are inverted every 1H period in the frame, power consumption of the display device 100 may increase.

However, the data driver 140 according to the exemplary embodiment of the present invention inverts the polarities of the data voltages every first frame FRM1 and outputs the data voltages. When the polarities of the data voltages are inverted every first frame FRM1, the power consumption of the display device 100 may be reduced compared to the power consumption of when the polarities of the data voltage are inverted every 1H period.

The output control signal SQINV having the second level L is used to control the data driver 140 such that the data driver 140 outputs the data signals that are inverted every one dot 1DOT (hereinafter, referred to as "one-dot inversion data signals").

For instance, the second frequency period F2 includes a plurality of second sub-frequency periods SF2. Each of the second sub-frequency periods SF2 includes a second frame FRM2 and a first period T1, as shown in FIG. 4. The second frequency has the level lower than that of the first frequency. The period for the second frame FRM2 is set longer than that of the first frame FRM1.

The second frame FRM2 is disposed at a start position of the second sub-frequency period SF2. The first period T1 corresponds to a period of the second sub-frequency period SF2 except for the second frame FRM2 of the second sub-frequency period SF2. For instance, the first period T1 is positioned to follow the second frame FRM2.

The data driver 140 of the display device 100 receives the still image during the second frames FRM2 of the second sub-frequency periods SF2. Hereinafter, the charging operation of the pixels PX during a leftmost second sub-frequency period SF2 among the plurality of second sub-frequency periods SF2 will be described in detail as a representative example.

The data driver 140 applies the data voltages corresponding to the still image signals to the pixels PX through the data lines D1_1, D2_1, . . . , D1_m, and D2_m during the second frame FRM2 of the leftmost second sub-frequency period SF2. In addition, the data driver 140 does not apply the data voltages corresponding to the still image signals to the pixels PX during the first period T1 of the leftmost second sub-frequency period SF2 in response to the control of the timing controller 120.

For instance, the timing controller 120 compares a previous frame image with a present frame image, and determines that the present frame image is the still image when the previous frame image is the same as the present frame image. In this case, the timing controller 120 controls the data driver 140 such that the data driver 140 does not apply the data voltages to the pixels PX during the first period T1.

The pixels PX are charged with the pixel voltage corresponding to the data voltages during the second frame FRM2. In addition, the pixels PX maintain the pixel voltage during the first period T1. This will be described in detail later.

The data driver 140 applies the one-dot inversion data signals to the data lines D1_1, D2_1, . . . , D1_m, and D2_m during the second frame FRM2 of the particular second sub-frequency period SF2 in response to the output control signal SQINV having the second level L. For instance, the polarities of the data voltages are inverted every data line during the second frequency period F2. For instance, the positive data voltages +VD and the negative data voltages −VD are alternately applied to the data lines D1_1, D2_1, . . . , D1_m, and D2_m.

For instance, the positive data voltages +VD are applied to the first data lines D1_1, . . . , D1_m during the second frame FRM2 of the leftmost second sub-frequency period SF2 shown in FIG. 4. Accordingly, the positive data voltages +VD are applied to the first data lines D1_j to D1_j+3 as shown in FIG. 5B.

The negative data voltages −VD are applied to the second data lines DL2_1, . . . , DL2_*m* during the second frame FRM2 of the leftmost second sub-frequency period SF2. Accordingly, the negative data voltages −VD are applied to the second data lines D2_*j* to D2_*j*+3 as shown in FIG. 5B.

As a result, the positive data voltages +VD and the negative data voltages −VD are alternately applied to the data lines D1_1, D2_1, . . . , D1_*m*, and D2_*m*. During the second frame FRM2, the storage voltage Vcst having the direct current level is applied to the first and second storage lines SL1 and SL2.

The positive data voltages +VD and the negative data voltages −VD are applied to the pixels PX through the data lines D1_1, D2_1, . . . , D1_*m*, and D2_*m*. Each of the pixels PX applied with the positive data voltages +VD is charged with the pixel voltage corresponding to the positive data voltage +VD. Each of the pixels PX applied with the negative data voltages −VD is charged with the pixel voltage corresponding to the negative data voltage −VD.

For the convenience of explanation, FIG. 5B shows the pixels PX. The pixels PX applied with the data voltages during the second frame FRM2 of the leftmost second sub-frequency period SF2 are driven in a row-inversion manner as shown in FIG. 5B. For instance, the polarities of the pixels PX are inverted in the unit of a row. The pixel voltage charged in the pixels PX in the second frame FRM2 is maintained during the first period T1. This operation will be described in detail later.

The polarities of the data voltages corresponding to the still image signals are inverted every second sub-frequency period SF2. For instance, the still image signals applied to the data driver 140 in the second frames FRM2 of the second sub-frequency periods SFs shown in FIG. 4 are the same as each other. However, the polarities of the data voltages corresponding to the still image signals are inverted every second frame FRM2 while the data voltages are applied to the pixels PX through the data lines D1_1, D2_1, . . . , D1_*m*, and D2_*m*. Thus, the polarities of the pixels PX are inverted every second frame FRM2 and maintained during the first period T1.

When each pixel PX maintains the same polarity every second sub-frequency period SF2, the display panel 110 may be deteriorated. However, when the polarities of the pixels PX are inverted every second sub-frequency period SF2, the display panel 110 may be prevented from being deteriorated.

The data driver 140 does not apply the data voltages to the pixels PX during the first periods T1 of the second sub-frequency periods SF2. When the direct current voltage is applied to the first and second storage lines SL and SL2, the pixel voltages of the positive and negative pixels (+, −) are gradually discharged to the level of the common voltage Vcom, as a discharge level DCL shown in FIG. 4. In this case, the still image might not be displayed normally.

However, the storage voltage Vcst according to the exemplary embodiment of the present invention includes a first storage voltage Vcst1 and a second storage voltage Vcst2. The first and second storage voltages Vcst1 and Vcst2 are applied to the pixels PX through the first or second storage lines SL1 or SL2 in accordance with the polarities of the pixels PX during the first periods T1.

The first storage voltage Vcst1 is applied to the positive pixels (+) through the first and second storage lines SL1 or SL2 during the first periods T1. The first storage voltage Vcst1 is changed to a voltage level inversely proportional to the discharge level DCL of the positive pixels (+) during the first periods T1. In this case, the discharge of the positive pixels (+) may be prevented by the first storage voltage Vcst1.

The second storage voltage Vcst2 is applied to the negative pixels (−) through the first and second storage lines SL1 or SL2 during the first periods T1. The second storage voltage Vcst2 is changed to a voltage level inversely proportional to the discharge level DCL of the negative pixels (−) during the first periods T1. In this case, the discharge of the negative pixels (−) may be prevented by the second storage voltage Vcst2.

For instance, referring to FIG. 4, the storage voltage having the direct current level may be applied to the first pixel PX1 (e.g., positive pixel (+)) through the first storage line SL1 during the first period T1 of the leftmost second sub-frequency period SF2. In this case, the voltage charged in the first pixel PX1 is gradually decreased to the level of the common voltage Vcom such that the voltage of the first pixel PX1 is discharged, as the discharge level DCL shown in FIG. 4.

In addition, during the first period T1 of the leftmost second sub-frequency period SF2, the first storage voltage Vcst1 is gradually increased to be inversely proportional to the discharge level DCL of the first pixel PX1 (e.g., positive pixel (+)) from the direct current level of the storage voltage Vcst, and is applied to the first pixel PX1 through the first storage line SL1.

The first storage voltage Vcst1 is applied to the storage electrode STE of the second capacitor C2 of the first pixel PX1. Accordingly, the voltage level of the pixel electrode PE of the second capacitor C2 that faces the storage electrode STE is boosted up by increasing the first storage voltage Vcst1. Since the first and second capacitors C1 and C2 share the pixel electrode PE, the voltage level of the first capacitor C1 of the first pixel PX1 may be boosted up by the increasing of the first storage voltage Vcst1.

When the voltage level of the pixel electrode PE of the first pixel PX1 is boosted up by the first storage voltage Vcst1, the first pixel PX1 may maintain the pixel voltage, which is charged therein in the second frame FRM2, during the first period T1 in the leftmost second sub-frequency period SF2, as shown in FIG. 4.

For instance, the level of the first storage voltage Vcst1 may be set to be inversely proportional to the discharge level DCL of the positive pixels (+) in consideration of the discharge rate of the pixel voltage that is charged in the positive pixels (+) during the first period T1. Accordingly, the positive pixels (+) may maintain the pixel voltage, which is charged therein in the second frame FRM2, during the first period T1.

In addition, referring to FIG. 4, the storage voltage having the direct current level may be applied to the second pixel PX2 (e.g., negative pixel (−)) through the second storage line SL2 during the first period T1 of the leftmost second sub-frequency period SF2. In this case, the voltage charged in the second pixel PX2 is gradually increased to the level of the common voltage Vcom such that the voltage of the second pixel PX2 is discharged, as the discharge level DCL shown in FIG. 4.

In addition, during the first period T1 of the leftmost second sub-frequency period SF2, the second storage voltage Vcst2 is gradually decreased to be inversely proportional to the discharge level DCL of the second pixel PX2 (e.g., negative pixel (−)) from the direct current level of the storage voltage Vcst, and is applied to the second pixel PX2 through the second storage line SL2.

The second storage voltage Vcst2 is applied to the storage electrode STE of the second capacitor C2 of the second pixel PX2. Accordingly, the voltage level of the pixel electrode PE of the second capacitor C2 that faces the storage electrode STE is boosted down by decreasing the second storage voltage Vcst2. Since the first and second capacitors C1 and C2 share the pixel electrode PE, the voltage level of the first capacitor C1 of the second pixel PX2 may be boosted down by the decreasing of the second storage voltage Vcst2.

When the voltage level of the pixel electrode PE of the second pixel PX2 is boosted down by the second storage voltage Vcst2, the second pixel PX2 may maintain the pixel voltage, which is charged therein in the second frame FRM2, during the first period T1 in the leftmost second sub-frequency period SF2, as shown in FIG. 4.

For instance, the level of the second storage voltage Vcst2 may be set to be inversely proportional to the discharge level DCL of the negative pixels (−) in consideration of the discharge rate of the pixel voltage that is charged in the negative pixels (−) during the first period T1. Accordingly, the negative pixels (−) may maintain the pixel voltage, which is charged therein in the second frame FRM2, during the first period T1.

In second sub-frequency periods SF2 following the leftmost second sub-frequency period SF2 of FIG. 4, the positive and negative pixels (+) and (−) maintain the pixel voltages, which are charged therein in the second frames FRM2, during the first periods T1 by the first and second storage voltages Vcst1 and Vcst2.

Due to the above-mentioned operation, the pixel voltages charged in the pixels PX may be maintained without being discharged during the first periods T1 of the second frequency periods F2. Thus, although the data voltages are not applied to the pixels PX during the second frequency periods F2, the image (e.g., still image) may be displayed normally.

Thus, the display device 100 according to the exemplary embodiment of the present invention may reduce the power consumption thereof and normally display the still image thereon.

Figure 6:
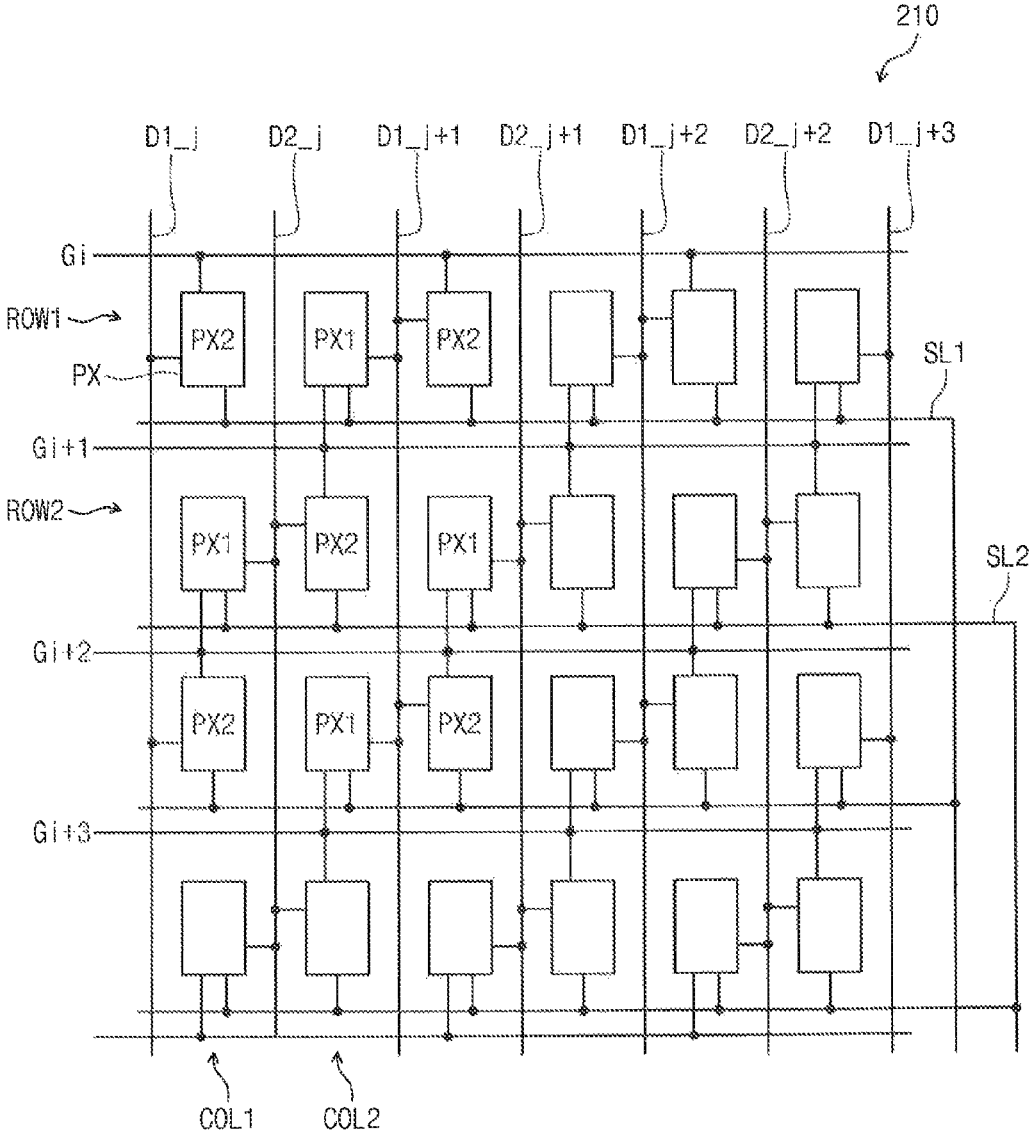
FIG. 6 is a view showing a configuration of a display panel of a display device, according to an exemplary embodiment of the present invention.

FIG. 6 is a view showing a configuration of a display panel 210 of a display device, according to an exemplary embodiment of the present invention.

The display panel 210 shown in FIG. 6 may be included in a display device having the same structure and function as those of the display device 100. The display panel 210 may have different structure and function from the display panel 110 shown in FIGS. 1 and 2. In addition, the configuration of pixels PX shown in FIG. 6 is the same as that of the pixel shown in FIG. 3.

Referring to FIG. 6, the pixels PX are arranged in a matrix form. The pixels PX include a plurality of first pixels PX and a plurality of second pixels PX2. The first pixels PX1 are alternately arranged with the second pixels PX2 in the row and column directions.

In addition, the first and second pixels PX1 and PX2 arranged in the first row ROW1 are connected to a corresponding one of the first data lines D1_*j* to D1_*j*+3. The first and second pixels PX1 and PX2 arranged in the second row ROW2 adjacent to the first row ROW1 are connected to a corresponding one of the second data lines D2_*j* to D2_*j*+2. The first row ROW1 and the second row ROW2 are repeatedly arranged in the column direction.

For instance, a first pixel in the first row ROW1 and the second column and a second pixel in the first row ROW1 and a third column are commonly connected to a corresponding one (e.g., D1_*j*+1) of the first data lines D1_*j* to D1_*j*+3. A first pixel in the second row ROW2 and the first column and a second pixel in the second row ROW2 and the second column are commonly connected to a corresponding one (e.g., D2_*j*) of the second data lines D2_*j* to D2_*j*+2.

The gate lines Gi to Gi+3 include first gate lines Gi and Gi+2 and second gate lines Gi+1 and Gi+3. The first gate lines Gi and Gi+2 correspond to odd-numbered gate lines of the gate lines Gi to Gi+3, and the second gate lines Gi+1 and Gi+3 correspond to even-numbered gate lines of the gate lines Gi to Gi+3.

In addition, the first and second pixels PX1 and PX2 arranged in a first column COL1 are connected to a corresponding one of the first gate lines Gi and Gi+2. The first and second pixels PX1 and PX2 arranged in a second column COL2 adjacent to the first column COL1 are connected to a corresponding one of the second gate lines Gi+1 and Gi+3. The first and second columns COL1 and COL2 are repeatedly arranged in the row direction.

For instance, a first pixel in the second row ROW2 and the first column and a second pixel in the third row and the first column are commonly connected to a corresponding one (e.g., Gi+2) of the first gate lines Gi and Gi+2. A first pixel in the first row ROW1 and the second column and a second pixel in the second row ROW2 and the second column are commonly connected to a corresponding one (e.g., Gi+1) of the second gate lines Gi+1 and Gi+3.

The first storage line SL1 and the second storage line SL2 are alternately connected to the pixels PX in the unit of a row.

Figure 7A:
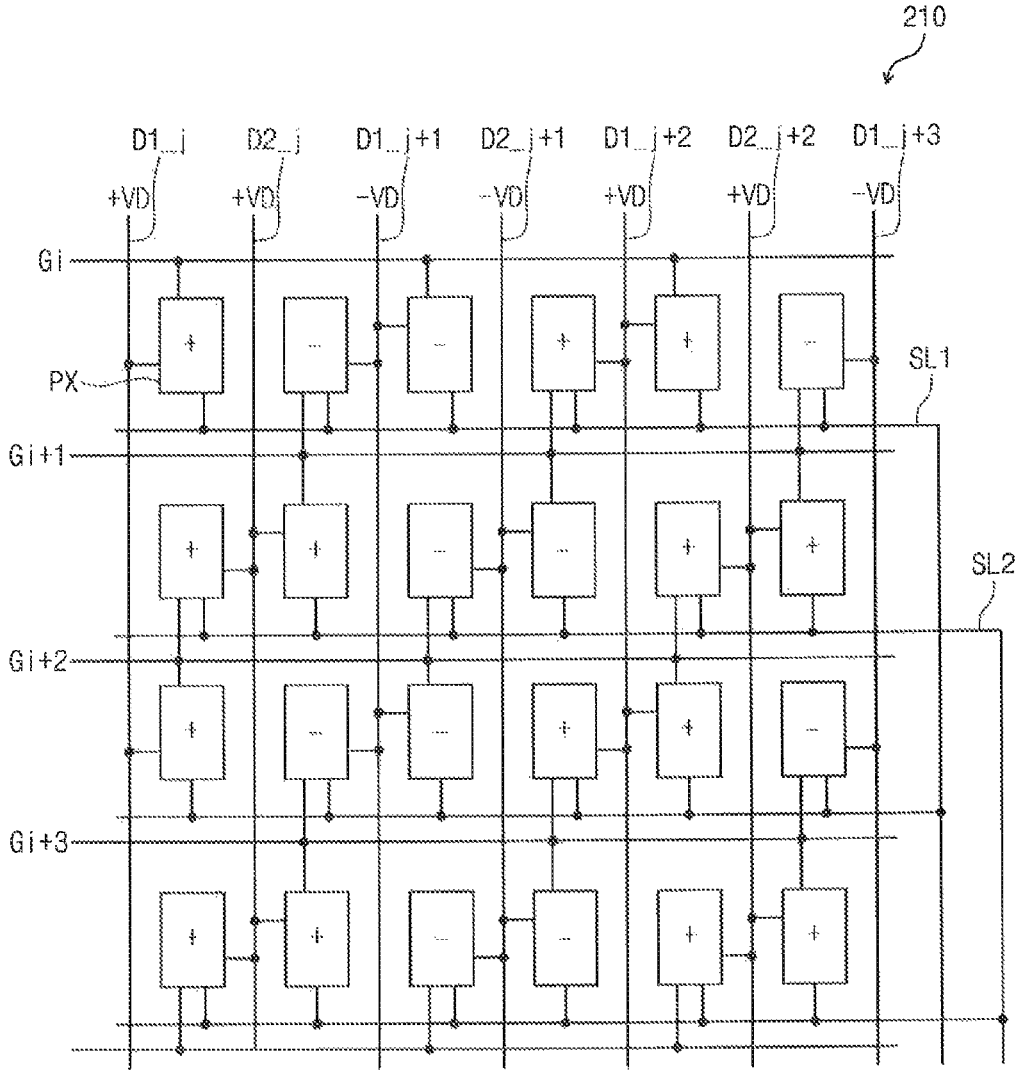
FIGS. 7A and 7B are views showing driving states of pixels shown in FIG. 6, according to an exemplary embodiment of the present invention.
Figure 7B:
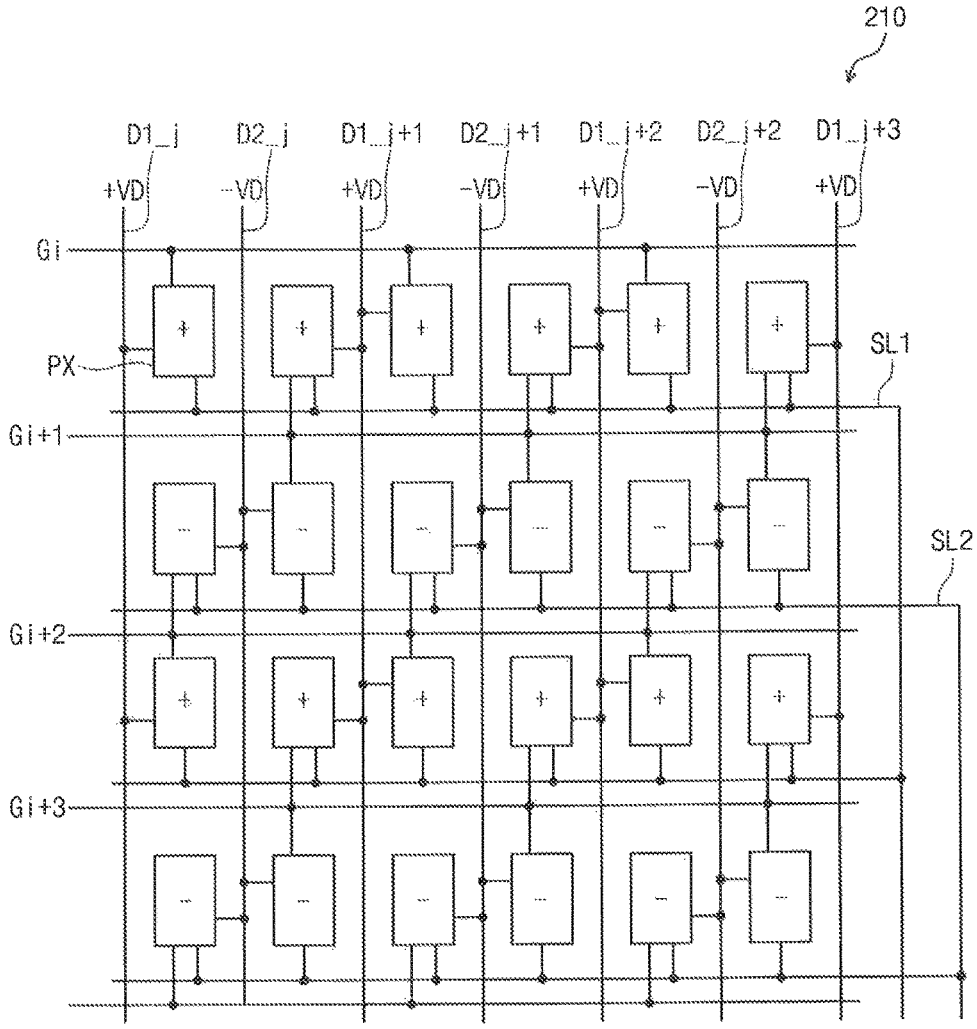

FIGS. 7A and 7B are views showing driving states of the pixels shown in FIG. 6, according to an exemplary embodiment of the present invention.

The timings of the signals applied to the display device according to this exemplary embodiment are substantially the same as those of the signals shown in FIG. 4. Accordingly, the driving of the pixels shown in FIGS. 7A and 7B will be described with reference to the signal timings shown in FIG. 4.

Referring to FIG. 7A, the data driver 140 applies the two-dot (2DOT) inversion data signals to the data lines D1_*j*, D2_*j*, . . . , D1_*j*+3, and D2_*j*+2 every first frame FRM1 in response to the output control signal SQINV having the first level H.

Therefore, the positive data voltages +VD and the negative data voltages −VD are alternately applied to the data lines D1_*j*, D2_*j*, . . . , D1_*j*+3, and D2_*j*+2 every two data lines as shown in FIG. 7A. Thus, the positive data voltages +VD and the negative data voltages −VD are applied to the pixels PX through the data lines D1_*j*, D2_*j*, . . . , D1_*j*+3, and D2_*j*+2.

The pixels PX applied with the positive data voltages +VD are charged with the pixel voltage corresponding to the positive data voltage +VD, and the pixels PX applied with the negative data voltages −VD are charged with the pixel voltage corresponding to the negative data voltage −VD.

Thus, the pixels PX applied with the data voltages in the leftmost first frame FRM1 during the first frequency period F1 are driven in two-dot inversion manner along the row direction as shown in FIG. 7A. For instance, the polarities of the pixels PX arranged in the rows are inverted every two pixels along the row direction.

The polarities of the data voltages are inverted every first frame FRM1 during the first frequency period F1. Accordingly, the polarities of the pixels PX are inverted every first frame FRM1 during the first frequency period F1.

The data driver 140 applies the one-dot (1DOT) inversion data signals to the data lines D1_*j*, D2_*j*, . . . , D1_*j*+3, and D2_*j*+2 in the second frame FRM2 during the second frequency period F2 in response to the output control signal SQINV having the second level L (e.g., low level).

For instance, the positive data voltages +VD are applied to the first data lines D1_j to D1_j+3 as shown in FIG. 7B. The negative data voltages −VD are applied to the second data lines D2_j to D2_j+3 as shown in FIG. 7B. Thus, the positive data voltages +VD and the negative data voltages −VD are applied to the pixels PX through the data lines D1_j, D2_j, . . . , D1_j+3, and D2_j+2.

In this case, the pixels PX applied with the data voltages in each second frame FRM2 of the second frequency period F2 are driven such that the polarities of the pixels PX are inverted every row in each second frame FRM2. In addition, the polarities of the pixels PX are inverted every second frame FRM2 of the second frequency period F2 and are maintained during the first periods T1 of the second frequency period F2.

The charging operation in which the positive and negative pixels (+) and (−) maintain the pixel voltage charged therein by the first and second storage voltages Vcst1 and Vcst2 during the first period T1 is substantially the same as that of the pixels PX shown in FIG. 5B. Accordingly, a detailed description about the charging operation of the pixels PX according to the first and second storage voltages Vcst1 and Vcst2 is omitted.

Thus, the display device according to the exemplary embodiment may reduce power consumption and normally display a still image.

Figure 8:
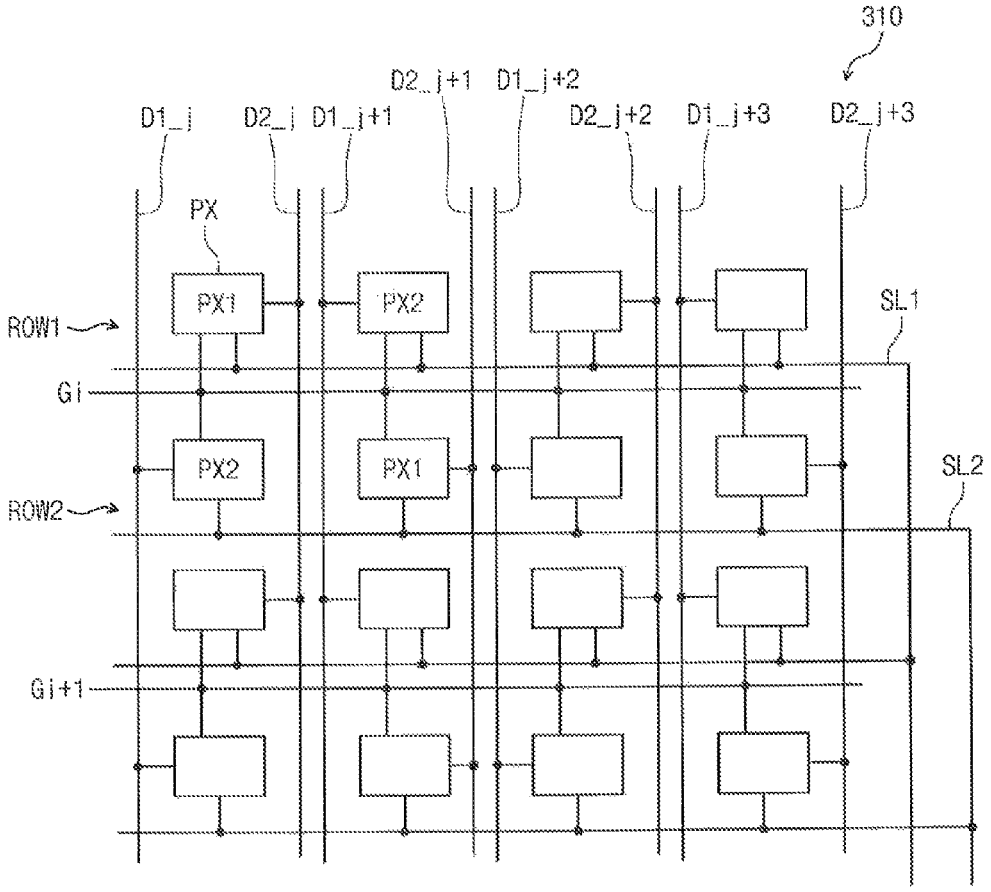
FIG. 8 is a view showing a display panel of a display device, according to an exemplary embodiment of the present invention.

FIG. 8 is a view showing a configuration of a display panel 310 of a display device, according to an exemplary embodiment of the present invention.

The display panel 310 shown in FIG. 8 may be included in a display device having the same structure and function as those of the display device 100 shown in FIG. 1. The display panel 310 may have different structure and function from the display panel 110 shown in FIGS. 1 and 2 or the display panel 210 in FIG. 6. In addition, the configuration of pixels PX shown in FIG. 8 is the same as that of the pixel shown in FIG. 3.

Referring to FIG. 8, the pixels PX are arranged in the matrix form. The pixels PX include a plurality of first pixels PX1 and a plurality of second pixels PX2. The first pixels PX1 are alternately arranged with the second pixels PX2 in the row and column directions.

As shown in FIG. 8, each pixel PX has a rectangular shape having a long side in the row direction and a short side in the column direction. However, the present invention is not limited thereto. For instance, each pixel PX may have a rectangular shape having the short side in the row direction and the long side in the column direction as described in FIG. 2. In addition, each pixel PX may have a square shape.

The first pixels PX1 arranged in the first and second rows ROW1 and ROW2 are connected to a corresponding one of the second data lines D2_j to D2_j+3. The second pixels PX2 arranged in the first and second rows ROW1 and ROW2 are connected to a corresponding one of the first data lines D1_j to D1_j+3.

In addition, the first and second pixels PX1 and PX2 arranged in the first row ROW1 and the second and first pixels PX2 and PX1 arranged in the second row ROW2 are commonly connected to a corresponding one (e.g., Gi) of the gate lines Gi and Gi+1.

The first storage line SL1 and the second storage line SL2 are alternately connected to the pixels in the unit of row. For instance, the first storage line SL1 is connected to the first and second pixels PX1 and PX2 arranged in the first row ROW1. The second storage line SL2 is connected to the first and second pixels PX1 and PX2 arranged in the second row ROW2. The first row ROW1 and the second row ROW2 are repeated in the column direction.

Figure 9:
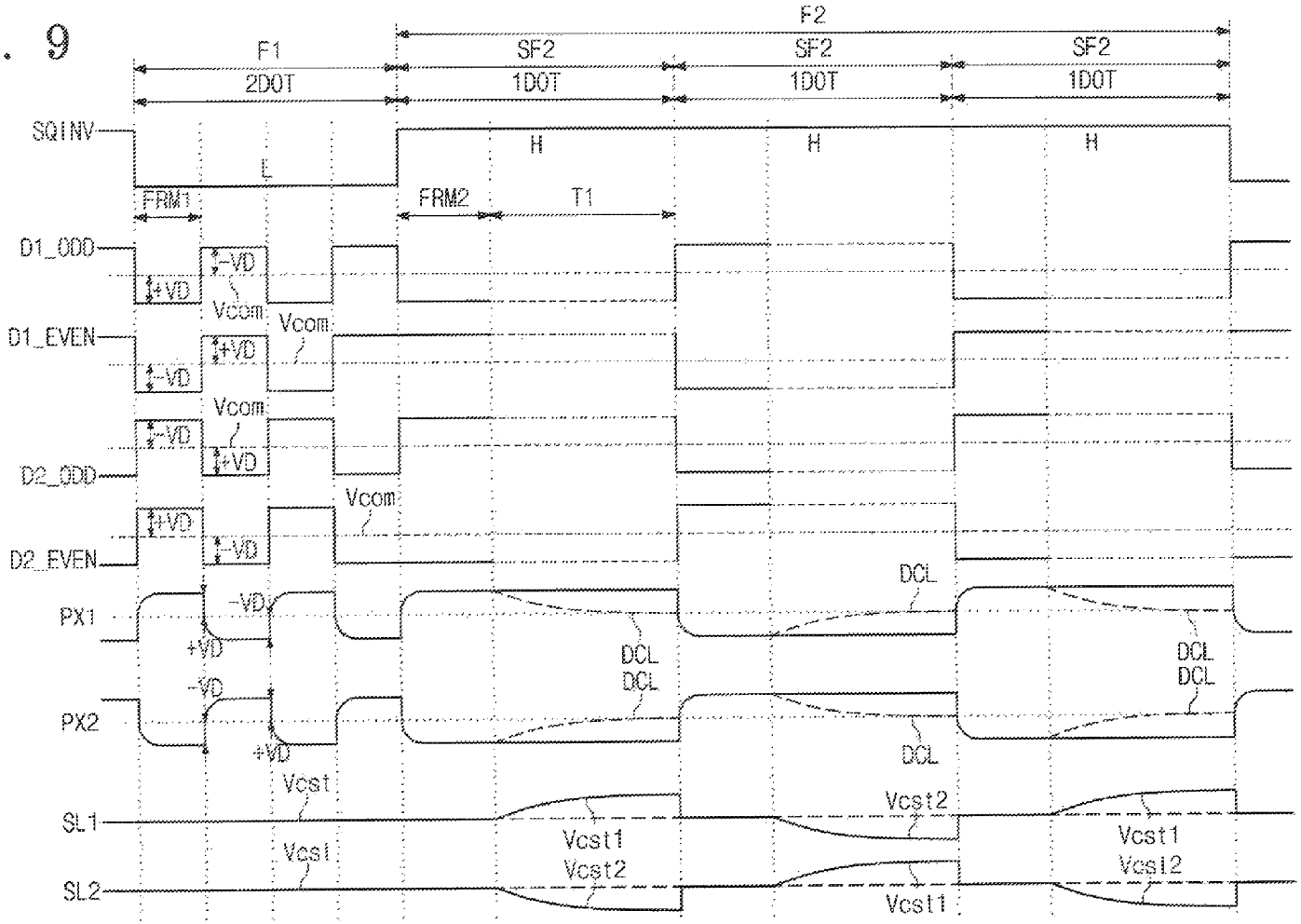
FIG. 9 is a signal timing diagram showing an operation of pixels shown in FIG. 8, according to an exemplary embodiment of the present invention.
Figure 10A:
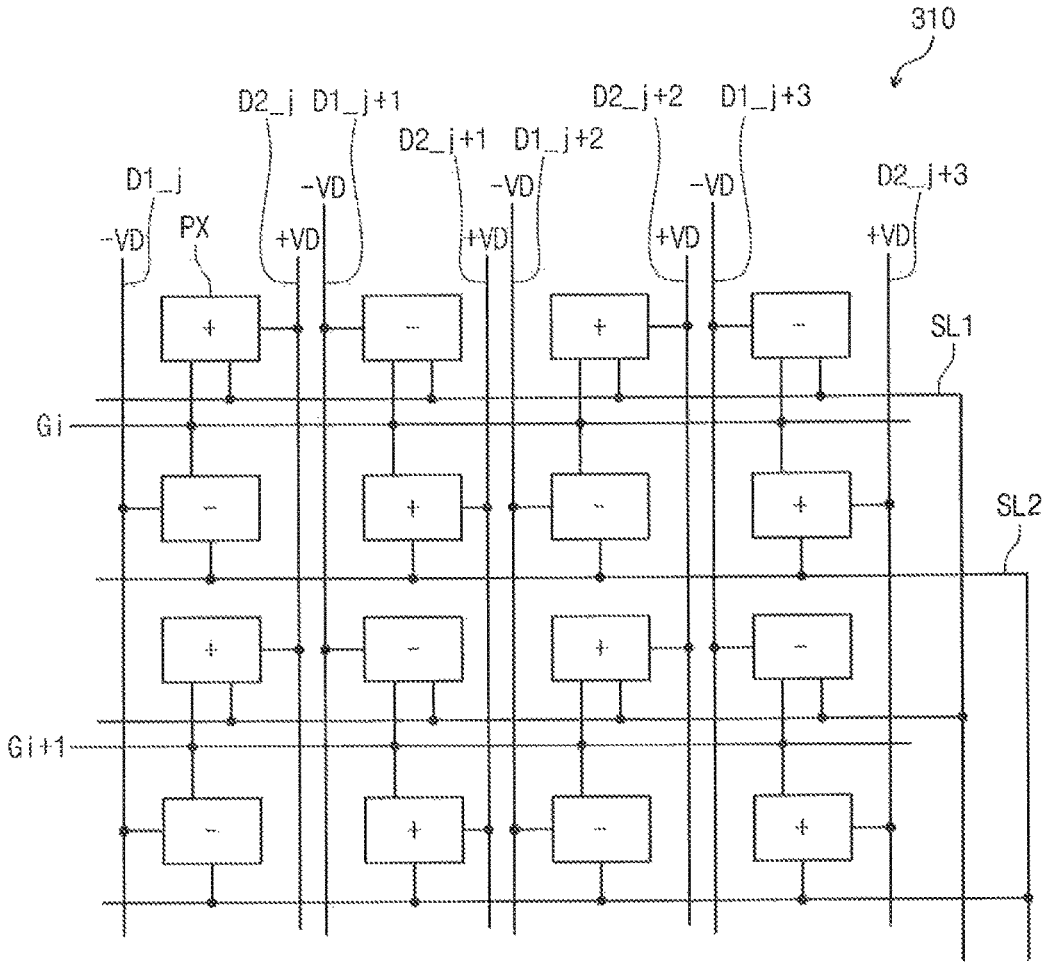
FIGS. 10A and 10B are views showing driving states of the pixels shown in FIG. 8, according to an exemplary embodiment of the present invention.
Figure 10B:
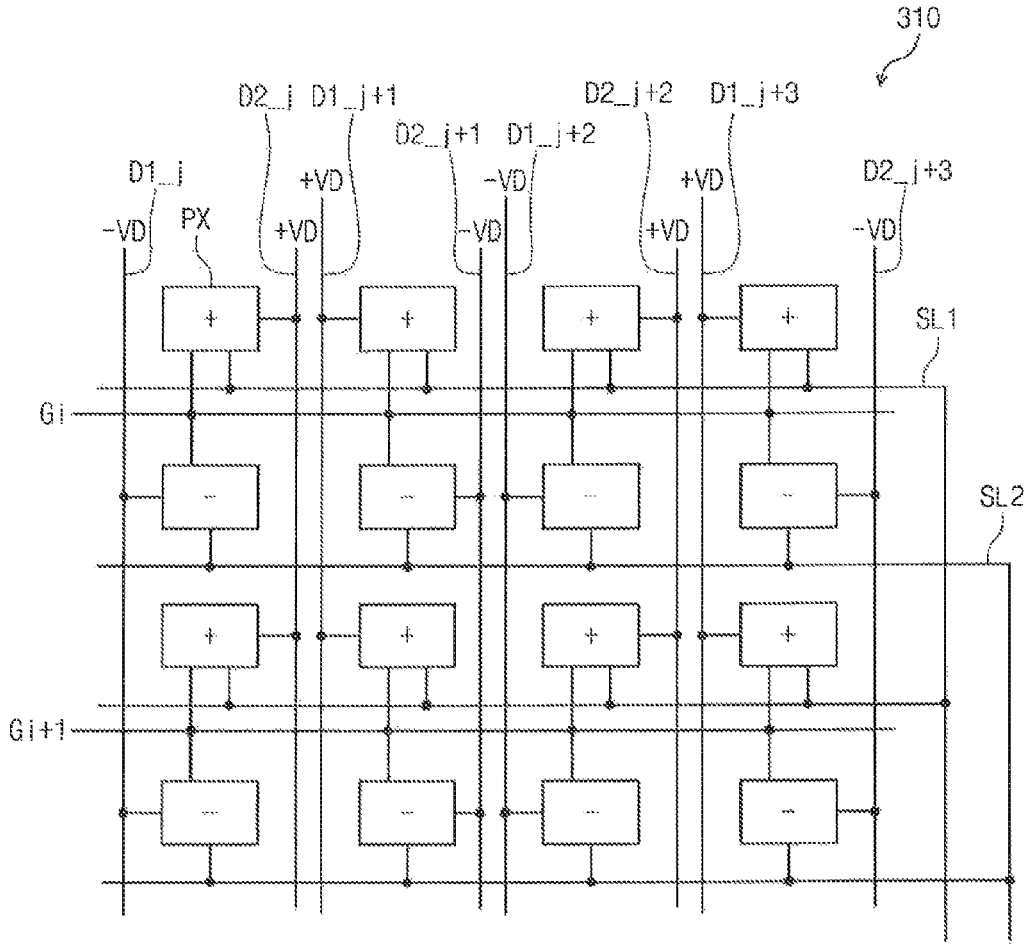

FIG. 9 is a timing diagram showing an operation of pixels shown in FIG. 8, according to an exemplary of the present invention and FIGS. 10A and 10B are views showing driving states of the pixels shown in FIG. 9, according to an exemplary of the present invention.

The signal timing diagram shown in FIG. 9 is substantially the same as the signal timing diagram shown in FIG. 4 except for the timings of the output control signal SQINV and the data voltages applied to the data lines. Hereinafter, the different signal timings of FIG. 9 from those of FIG. 4 will be described in detail.

Referring to FIGS. 9, 10A, and 103, the output control signal SQINV has the second level L during the first frequency period F1, and has the first level H during the second frequency period F2.

In FIG. 9, the timings of the odd-numbered first data lines D1_ODD correspond to the timings of the odd-numbered first data lines D1_j and D1_j+2 of the first data lines D1_j to D1_j+3 of FIG. 8. The timings of the even-numbered first data lines D1_EVEN correspond to the timings of the even-numbered first data lines D1_j+1 and D1_j+3 of the first data lines D1_j to D1_j+3 of FIG. 8.

In FIG. 9, the timings of the odd-numbered second data lines D2_ODD correspond to the timings of the odd-numbered second data lines D2_j and D2_j+2 of the second data lines D2_j to D2_j+3 of FIG. 8. The timings of the even-numbered second data lines D2_EVEN correspond to the timings of the even-numbered second data lines D2_j+1 and D2_j+3 of the second data lines D2_j to D2_j+3 of FIG. 8.

The data driver 140 applies the one-dot (1DOT) inversion data signals to the data lines D1_j, D2_j, . . . , D1_j+3, and D2_j+3 every first frame FRM1 in response to the output control signal SQINV having the second level L.

For instance, referring back to FIG. 9, the negative data voltages −VD are applied to the first data lines D1_j to D1_j+3 in the leftmost first frame FRM1 shown in FIG. 9. Thus, the negative data voltages −VD are applied to the first data lines D1_j to D1_j+3 as shown in FIG. 10A.

The positive data voltages +VD are applied to the second data lines D2_j, . . . , D2_j+3 during the leftmost first frame FRM1. Accordingly, the positive data voltages +VD are applied to the second data lines D2_j to D2_j+3 as shown in FIG. 10A.

Thus, the negative data voltages −VD and the positive data voltages +VD are alternately applied to the data lines D1_j, D2_j, . . . , D1_j+3, and D2_j+3 as shown in FIG. 10A. Therefore, the positive data voltages +VD and the negative data voltages −VD are applied to the pixels PX through the data lines D1_j, D2_j, . . . , D1_j+3, and D2_j+3.

In this case, the pixels PX applied with the data voltages during the leftmost first frame FRM1 are driven in the one-dot inversion manner as shown in FIG. 10A.

For instance, the polarities of the data voltages applied to the data lines D1_j, D2_j, . . . , D1_j+3, and D2_j+3 are inverted every first frame FRM1 during the first frequency period F1. Thus, the polarities of the pixels PX are inverted every first frame FRM1.

The data driver 140 receives the still image signals in the second frames FRM2 of the second sub-frequency periods SF2. The data driver 140 applies the data voltages corresponding to the still image signals to the pixels PX. The pixels PX are charged with the pixel voltages corresponding to the data voltages in the second frames FRM2. The pixels PX maintain the pixel voltages during the first periods T1.

Hereinafter, the charging operation of the pixels PX in the leftmost second sub-frequency period SF2 among the plurality of second sub-frequency periods SF2 of the second frequency period F2 will be described as a representative example.

Referring back to FIG. 8, the data driver 140 applies the two-dot (2DOT) inversion data voltages to the data lines D1_*j*, D2_*j*, . . . , D1_*j*+3, and D2_*j*+3 during the second frame FRM2 of the leftmost second sub-frequency period SF2 in response to the output control signal SQINV having the first level H (e.g., high level H).

For instance, the negative data voltages −VD are applied to the odd-numbered first data lines D1_*j* and D1_*j*+2 of the first data lines D1_*j* to D1_*j*+3 during the second frame FRM2 of the leftmost second sub-frequency period SF2. In addition, the positive data voltages +VD are applied to the odd-numbered second data lines D2_*j* and D2_*j*+2 of the second data lines D2_*j* to D2_*j*+3 during the second frame FRM2 of the leftmost second sub-frequency period SF2.

Accordingly, the negative data voltages −VD are applied to the odd-numbered first data lines D1_*j* and D1_*j*+2 and the positive data voltages +VD are applied to the odd-numbered second data lines D2_*j* and D2_*j*+2, as shown in FIG. 10A.

The positive data voltages +VD are applied to the even-numbered first data lines D1_*j*+1 and D1_*j*+3 among the first data lines D1_*j* to D1_*j*+3 during the second frame FRM2 of the leftmost second sub-frequency period SF2. In addition, the negative data voltages −VD are applied to the even-numbered second data lines D2_*j*+1 and D2_*j*+3 among the second data lines D2_*j* to D2_*j*+3 during the second frame FRM2 of the leftmost second sub-frequency period SF2.

Therefore, the negative data voltages −VD are applied to the even-numbered first data lines D1_*j*+1 and D1_*j*+3 and the positive data voltages +VD are applied to the even-numbered second data lines D2_*j*+1 and D2_*j*+3, as shown in FIG. 10B.

Thus, the positive data voltages +VD and the negative data voltages −VD are alternately applied to the data lines D1_*j*, D2_*j*, . . . , D1_*j*+3, and D2_*j*+3 every two data lines as shown in FIG. 10B.

Thus, the positive data voltages +VD and the negative data voltages −VD are applied to the pixels PX through the data lines D1_*j*, D2_, . . . , D1_*j*+3 and D2_*j*+3. In this case, the pixels PX applied with the data voltages during the second frame FRM2 of the leftmost second sub-frequency period SF2 are driven in a row-inversion manner.

The still image signals applied to the data driver 140 in the second frames FRM2 are the same as each other. The polarities of the data voltages corresponding to the still image signals and applied to the pixels PX are inverted every second frame FRM2.

The charging operation in which the positive and negative pixels (+) and (−) maintain the pixel voltage charged therein by the first and second storage voltages Vcst1 and Vcst2 during the first period T1 is substantially the same as that of the pixels PX shown in FIG. 5B. Accordingly, a detailed description about the charging operation of the pixels PX according to the first and second storage voltages Vcst1 and Vcst2 is omitted.

In second sub-frequency periods SF2 following the leftmost second sub frequency period SF2 of FIG. 9, the positive and negative pixels (+) and (−) maintain the pixel voltages, which are charged therein in the second frames FRM2, during the first periods T1 by the first and second storage voltages Vcst1 and Vcst2.

Thus, the display device according to this exemplary embodiment may reduce its power consumption and normally display a still image.

Although the present invention have been described with reference to exemplary embodiments thereof it will be understood that the present invention should not be limited to the disclosed exemplary embodiments but various changes and modifications can be made by one ordinary skilled in the art within the spirit and scope of the present invention as hereinafter claimed.

What is claimed is:

1. A display device comprising:

a display panel that includes a plurality of pixels connected to a plurality of gate lines for receiving gate signals, a plurality of data lines for receiving data voltages, and a storage line for receiving a storage voltage;

a gate driver configured to generate the gate signals; and a data driver configured to operate in a first period having a first frequency and a second period having a second frequency different from the first frequency to generate the data voltages, wherein the data voltages comprises a positive data voltage and a negative data voltage, and polarities of the data voltages are inverted every two data lines during the first period and inverted every single data line during the second period, wherein the first period comprises a plurality of first frames, the data driver receives image signals every first frame, and the polarities of the data voltages are inverted every first frame, and wherein the second period comprises a plurality of second sub-periods, the second sub-periods comprise a second frame and a first sub-period following the second frame, wherein the data driver is configured to receive still image signals during the second frame to convert the still image signals to the data voltages, and the data driver is configured not to output the converted data voltages during the first sub-period.

2. The display device of claim 1, wherein the second frame is longer than the first frame and the polarities of the data voltages are inverted every second frame.

3. The display device of claim 1, wherein the storage voltage has a direct current voltage level during the second frame.

4. A display device comprising:

a display panel that includes a plurality of pixels connected to a plurality of gate lines for receiving gate signals, a plurality of data lines for receiving data voltages, and a storage line for receiving a storage voltage;

a gate driver configured to generate the gate signals; and a data driver configured to operate individually in first and second frequency periods to generate the data voltages, wherein the data voltages comprise a positive data voltage and a negative data voltage, and polarities of the data voltages are inverted every data line during the first frequency period and inverted every two data lines during the second frequency period, wherein the first frequency period comprises a plurality of first frames, the data driver is configured to receive image signals every first frame and to convert the image signals to the data voltages, and the polarities of the data voltages are inverted every first frame, and the storage voltage has a direct current voltage level during the first frequency period, and wherein the second frequency period comprises a plurality of second sub-frequency periods, the second sub-frequency periods comprise a second frame and a first period following the second frame, wherein the data driver is configured to receive still image signals during the second frame and to convert the still image signals to the data voltages, and the data driver is configured not to output the data voltages during the first period.

5. The display device of claim 4, wherein the pixels comprise a plurality of first pixels and a plurality of second pixels alternately arranged with the plurality of first pixels in row and column directions, wherein the data lines comprise first data lines and second data lines, the first pixels in a first row and a second row are connected to a corresponding one of the second data lines, the second pixels in the first row and the second row are connected to a corresponding one of the first data lines, and wherein the first and second pixels in the first row and the second row are commonly connected to a corresponding one of the gate lines, wherein the first row is adjacent to the second row.

6. The display device of claim 5, wherein the storage line comprises:

a first storage line connected to the first and second pixels arranged in the first row; and a second storage line connected to the first and second pixels arranged in the second row.

7. The display device of claim 4, wherein the second frame is longer than the first frame, the polarities of the data voltages are inverted every second frame, and the storage voltage has the direct current voltage level during the second frame.

8. The display device of claim 7, wherein the storage voltage comprises:

a first storage voltage changed to a voltage level inversely proportional to a discharge level when a positive pixel charged with the positive data voltage is discharged during the first period; and a second storage voltage changed to a voltage level inversely proportional to a discharge level when a negative pixel charged with the negative data voltage is discharged during the first period, and wherein the first and second storage voltages are applied to the pixels through the storage line in accordance with the polarities of the pixels during the first period.

* * * * *